US006761932B2

(12) United States Patent
Salter

(10) Patent No.: US 6,761,932 B2
(45) Date of Patent: Jul. 13, 2004

(54) METHOD TO IMPROVE ADHESION OF PRIMERS TO SUBSTRATES

(75) Inventor: Keith L. Salter, Delta, OH (US)

(73) Assignee: BASF Corporation, Southfield, MI (US)

( * ) Notice: Subject to any disclaimer, the term of this patent is extended or adjusted under 35 U.S.C. 154(b) by 0 days.

(21) Appl. No.: 10/227,144

(22) Filed: Aug. 23, 2002

(65) Prior Publication Data

US 2004/0037965 A1 Feb. 26, 2004

(51) Int. Cl.[7] ..... B05D 1/36
(52) U.S. Cl. ..... 427/402; 427/407.1; 427/419.1
(58) Field of Search ..... 427/402, 419.1, 427/407.1

(56) References Cited

U.S. PATENT DOCUMENTS

| | | | | |
|---|---|---|---|---|
| 3,695,942 A | * | 10/1972 | Binns | 148/247 |
| 4,539,048 A | | 9/1985 | Cohen | 106/287.17 |
| 4,539,049 A | | 9/1985 | Cohen | 106/287.17 |
| 4,650,526 A | | 3/1987 | Claffey et al. | 148/6.14 R |
| 5,026,440 A | | 6/1991 | Finnenthal et al. | 148/247 |
| 5,356,490 A | | 10/1994 | Dolan et al. | 148/247 |
| 5,397,390 A | | 3/1995 | Gorecki | 106/287.11 |
| 5,531,820 A | * | 7/1996 | Gorecki | 106/287.11 |
| 5,814,137 A | * | 9/1998 | Blohowiak et al. | 106/14.13 |
| 5,849,110 A | | 12/1998 | Blohowiak et al. | |
| 5,939,197 A | | 8/1999 | Blohowiak et al. | 428/413 |
| 5,964,928 A | | 10/1999 | Tomlinson | 106/14.21 |
| 6,037,060 A | | 3/2000 | Blohowiak et al. | |
| 6,083,309 A | | 7/2000 | Tomlinson | 106/14.21 |

FOREIGN PATENT DOCUMENTS

| | | | |
|---|---|---|---|
| CA | 2312807 | 11/1998 | C23C/22/34 |
| EP | 420 293 | 5/1984 | C08J/5/12 |
| FR | 12276 | 4/1977 | C23F/7/00 |
| JP | 52 90433 | 7/1977 | C23F/7/06 |
| JP | 54 158341 | 12/1979 | C23F/7/00 |
| JP | 10 306996 | 11/1998 | F28F/13/18 |
| WO | WO96/17109 | 6/1996 | C23C/22/83 |

OTHER PUBLICATIONS

English Language machine translation of JP 10–306996 provided by JPO, Nov. 17, 1998.
Derwent Accession No. 99–055089/05, English Abstract for JP10 306996, Nov. 17, 1998.
Derwent Accession No. 06388B/04, English Abstract for FR7712276, Dec. 22, 1978.
Derwent Accession No. 33303C/19, English Abstract for JP54 158341, Dec. 14, 1979.
Derwent Accession No. 64029Y/36, English Abstract for JP52 90433, Jul. 29, 1977.
HCAPLUS Accession No. 1988:592196, Sugerman, Gerald et al., entitled "Corrosion Resistant, one hundred percent-solids, environmentally sound coating", Source: Proc. Water–Bornme Higher–Solids Coat. Symp. (1988), 15$^{th}$, 462–77, 2 pages.
HCAPLUS Accession No. 2000:824774, Braig, Adalbert, et al., entitled "Organic Corrosion inhibitors for water–borne, high solids, and powder coatings". Source: Proc. Int. Watervome, High–Solids. Powder Coat. Symp. (2000) 27$^{th}$, 360–372, 2 pages.
Kenrich Petrochemicals, Inc., entitled "Titanates, Zirconates and Aluminates in high solids and water–based coating," Oct. 1997, PPCJ, on 4 Pages.
"Interface Characterization of KEVLAR®/Phenolic Composites", by N. Subramaniam et al., SAMPE Quarterly, vol. 24, No. 3, Apr. 1993, pp. 15–20, NSDOCID Accession No. XP009017765.
"Enhanced Bonding of Fiber Reinforcements to Thermoset Resins", by G. Sugerman et al., 20$^{th}$ International SAMPE Technical Conference, Sep. 27–28, 1988, pp. 423–437, NSDOCID Accession No. XP001154997.
International Search Report for PCT/US02/18117, dated Nov. 10, 2003.

* cited by examiner

*Primary Examiner*—Michael Barr
(74) *Attorney, Agent, or Firm*—Michael F. Morgan

(57) ABSTRACT

A method comprising: providing a composition comprising a zirconium alkoxide and an acid, wherein the composition is not provided in a coating composition; and applying the composition to a substrate.

15 Claims, No Drawings

METHOD TO IMPROVE ADHESION OF PRIMERS TO SUBSTRATES

FIELD OF THE INVENTION

The present invention relates to a method of treating a substrate with a zirconium alkoxide.

BACKGROUND OF THE INVENTION

As used herein, "automotive refinish" refers to compositions and processes used in the repair of a damaged automotive finish, usually an OEM provided finish. Refinish operations may involve the repair of one or more outer coating layers, the repair or replacement of entire automotive body components, or a combination of both. The terms "refinish coating" or "repair coating" may be used interchangeably.

Automotive refinishers must be prepared to paint a wide variety of materials. Examples of commonly encountered materials are one or more previously applied coatings, plastic substrates such as RIM, SMC and the like, and metal substrates such as aluminum, galvanized steel, and cold rolled steel. Bare metal and plastic substrates are often exposed as a result of the removal of the previously applied coating layers containing and/or surrounding the defect area. However, it is often difficult to obtain adequate adhesion of refinish coatings applied directly to exposed bare substrates.

Among the many factors influencing the degree of refinish coating/substrate adhesion are the type of exposed substrate, the presence or absence of adhesion promoting pretreatments and/or primers, the size of the exposed area to be repaired, and whether previously applied "anchoring" coating layers surround the exposed repair area.

For example, refinish adhesion is particularly challenging when the exposed substrate is a bare metal such as galvanized iron or steel, aluminum or cold rolled steel. It is especially hard to obtain adequate refinish adhesion to galvanized iron. "Galvanized iron or steel" as used herein refers to iron or steel coated with zinc. "Steel" as used herein refers to alloys of iron with carbon or metals such as manganese, nickel, copper, chromium, molybdenum, vanadium, tungsten and cobalt.

Refinish operations have traditionally used adhesion pretreatments to overcome the adhesion problems associated with the coating of bare metal substrates. Pretreatment as used herein may refer to either mechanical or chemical alterations of the bare metal substrate. Mechanical alterations used to obtain improved adhesion include sanding, scuffing, and the like. Chemical alterations include treatment of the substrate with compositions such as chromic acid conversion coatings, acid etch primers and the like.

It would be desirable to provide a method that can improve the adhesion of coatings to substrates.

SUMMARY OF THE INVENTION

The present invention relates to a method comprising: providing a composition comprising a zirconium alkoxide and an acid, wherein the composition is not provided in a coating composition; and applying the composition to a substrate.

DETAILED DESCRIPTION

As used throughout, ranges are used as a shorthand for describing each and every value that is within the range. Any value within the range can be selected as the terminus of the range.

The adhesion of a coating on a substrate can be increased by treating the substrate with a zirconium alkoxide. The zirconium alkoxide is provided in a composition along with an acid. The composition is applied to a substrate. While the composition can comprise additional materials, the composition is not provided in a coating composition. Once the composition is applied to a substrate, the substrate can be rinsed, or the substrate need not be rinsed.

Zirconium alkoxide is a zirconium atom with four alkoxy groups. The zirconium alkoxide can be represented by the following general structure.

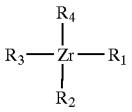

wherein, $R_1$, $R_2$, $R_3$, $R_4$ are each independently an alkoxy group. The alkoxy group can contain heteroatoms anywhere in the alkoxy. Examples of heteroatoms include, but are not limited to, nitrogen, oxygen, phosphorous, and sulfur. The alkoxy groups can be bridged to one another. In one embodiment, the zirconium alkoxide does not contain any other metals.

A preferred zirconium alkoxide has the following general structure:

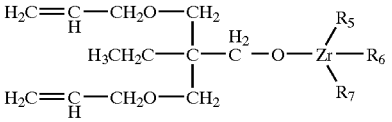

wherein $R_5$, $R_6$, and $R_7$ are each independently an alkoxy group as defined above.

Preferred zirconium alkoxides are Zirconium IV 2,2(bis-2-propenolatomethyl) butanolato, tris neodecanolato-O; Zirconium IV 2,2(bis-2-propenolatomethyl) butanolato, tris (dodecyl)benzensulfonato-O; Zirconium IV 2,2(bis-2-propenolatomethyl) butanolato, tris (dioctyl)phosphato-O; Zirconium IV 2,2(bis-2-propenolatomethyl) butanolato, tris 2-methyl-2-propenoato-O; Zirconium IV 2,2(bis-2-propenolatomethyl) butanolato, tris (dioxtyl) pyrophosphato-O; Zirconium IV 2,2(bis-2-propenolatomethyl) butanolato, tris 2-propenoato-O; Zirconium IV 2,2(bis-2-propenolatomethyl) butanolato, tris (2-ethylenediamino) ethylato; Zirconium IV bis 2,2(bis-2-propenolatomethyl) butanolato, bis (para amino benzoato-O); Zirconium IV bis 2,2(bis-2-propenolatomethyl) butanolato, bis (3-mercapto) propionato-O; Zirconium IV 2,2(bis-2-propenolatomethyl) butanolato, tris (2-amino) phenylato; Zirconium IV 2,2-dimethyl 1,3 propanedilato, bis (dioctyl) pyrophosphato-O, (adduct) 2 moles N,N-dimethylamino-alkyl propenoamide; Zirconium IV (2-ethyl, 2-propenolatomethyl) 1,3-propanedilato, cyclo bis 2-dimethylamino pyrophosphato-O,O adduct with 2 moles of methansulfonic acid; Zirconium IV tetrakis 2,2(bis-2propenolatomethyl)butanolato, adduct with 2 moles of ditridecyl, hydrogen phosphite; Zirconium IV 2-ethyl, 2-propenolatomethyl 1,3-propanediolato, cyclo di 2,2-(bis 2-propenolatomethyl) butanolato pyrophosphato-O,O; and Zirconium IV bis 2-ethylhexanolato, cyclo (di 2-ethylhexyl) pyrophosphato. All of the preceding zirconium alkoxides are available from Kenrich Petrochemicals, Inc. of Bayonne, N.J., and are listed in KEN-REACT® Reference Manual (Bulletin KR). Preferred zirconium alkoxides are Zirconium IV 2,2(bis-2-propenolatomethyl) butanolato, tris 2-methyl-2-propenoato-O and Zirconium IV 2,2(bis-2-propenolatomethyl) butanolato, tris 2-propenoato-O.

The above listed zirconium alkoxides have the following structures:

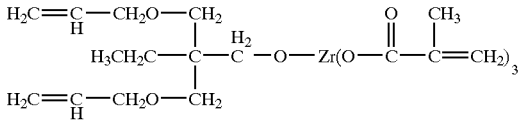

Zirconium IV 2,2(bis-2-propenolatomethyl)butanolato, tris 2-methyl-propenoato-O

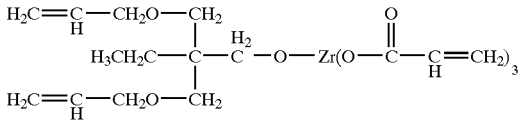

Zirconium IV 2,2(bis-2-propenolatomethyl)butanolato, tris 2propenoato-O

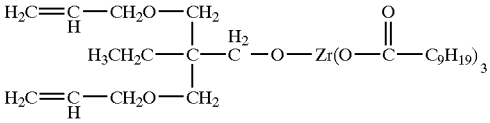

Zirconium IV 2,2(bis-2-propenolatomethyl)butanolato, tris neodecanolato-O

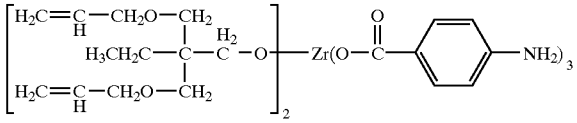

Zirconium IV bis 2,2(bis-2-propenolatomethyl)butanolato, bis(para amino benzoato-O)

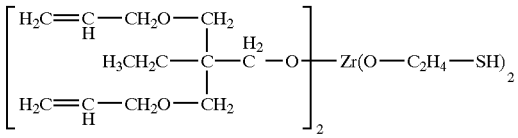

Zirconium IV bis 2,2(bis-2-propenolatomethyl)butanolato, bis(3mercapto) propionato-O

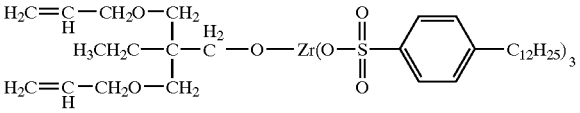

Zirconium IV 2,2(bis-2-propenolatomethyl)butanolato, tris (dodecyl)benzensulfonato-O

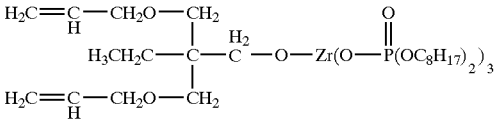

Zirconium IV 2,2(bis-2-propenolatomethyl)butanolato, tris (dioctyl)phosphato-O

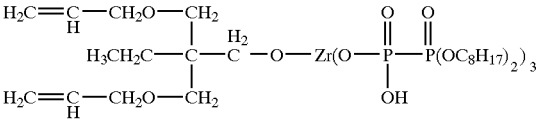

Zirconium IV 2,2(bis-2-propenolatomethyl)butanolato, tris (dioctyl)pyrophosphato-O

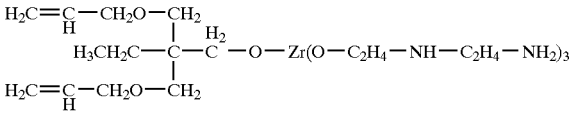

Zirconium IV 2,2(bis-2-propenolatomethyl)butanolato, tris (2-ethylenediamino)ethylato

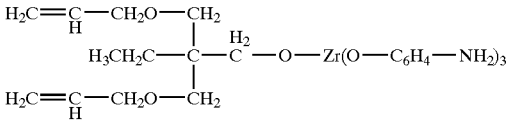

Zirconium IV 2,2(bis-2-propenolatomethyl)butanolato, tris (2-amino)phenylato

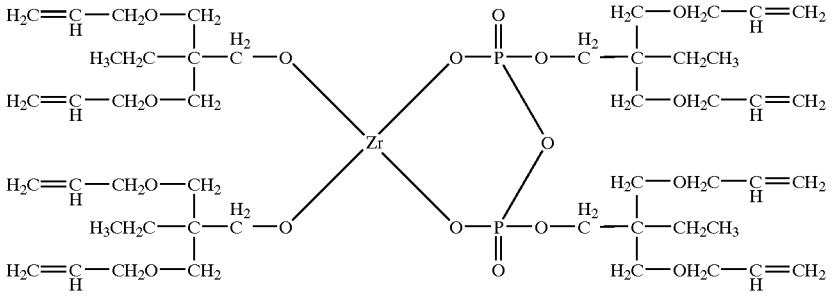

Zirconium IV 2-ethyl, 2-propenolatomethyl 1,3-propanedilato, cyclo di 2,2-(bis 2-propenolatomethyl) butanolato pyrophosphato-O,O

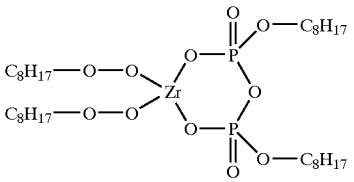

Zirconium IV bis 2-ethylhexanolato, cyclo (di 2-ethylhexyl) pyrophosphato

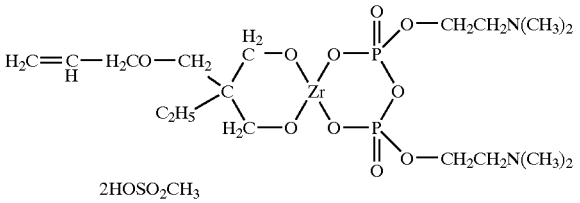

Zirconium IV (2-ethyl, 2-propenolatomethyl) 1,3-propanediolato, cyclo bis 2-dimethylamino pyrophosphato-O,O adduct with 2 moles of methanesulfonic acid

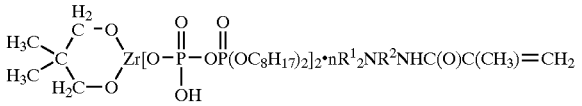

Zirconium IV 2,2-dimethyl 1,3 propanediolato, bis (dioxtyl) pyrophosphato-O, (adduct) 2 moles N,N- dimethylamino-alkyl propenoamide

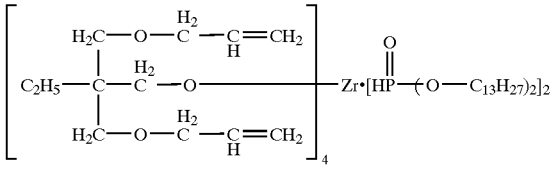

Zirconium IV tetrakis 2,2(bis-2 propenolatomethyl) butanolato, adduct with 2 moles of ditridecyl, hydrogen phosphite The zirconium alkoxide can be present in the composition in any amount. Preferably, the zirconium alkoxide is present in the composition in an amount from about 0.01% to about 5% by weight of the composition. More preferably the zirconium alkoxide is present in the composition in an amount from about 0.5% to about 2% by weight of the composition.

The acid can be any acid used for cleaning and/or etching a substrate. The term acid can also include esters of the acid. Examples of the acid include, but are not limited to, phosphoric acid and phosphoric acid esters. Preferably, the acid is provided as an aqueous composition.

In the aqueous composition, the acid is preferably present in the aqueous composition from about 5% to less than 100% by weight. Additionally, the acid can used as a neat composition when the acid is a liquid at temperatures for coating processes. The acid can be present in the composition in any amount. Preferably, the acid is present in the composition in an amount from about 0.1% to about 10.0% by weight of the composition. More preferably the acid is present in the composition in an amount from about 2.0% to about 5.0% by weight of the composition.

The composition of the present invention can further comprise any other materials that are used for cleaning and/or treating a substrate for coating. Examples of other materials include, but are not limited to, solvents, such as ketones, alcohols, polyols, esters, aromatic hydrocarbons, aliphatic hydrocarbons, and glycol ethers.

The composition can be applied by brushing, wiping, spraying, dipping, roller-coating, or flow-coating.

The substrate can be a metal. Metals include, but are not limited to, steel, galvanized steel, iron, galvanized iron, aluminum, aluminum alloy, zinc, zinc alloy plated steel, cold rolled steel, titanium, titanium alloy, cadmium, and magnesium.

The method of the present invention can be used to treat a substrate in order to increase the adhesion of a coating to the substrate. The method can be used in a refinish operation wherein a refinish coating is applied to bare substrate, an OEM operation wherein an original equipment manufacturer coating is applied to a bare substrate, or for any operation wherein a coating is applied to a bare substrate. The coating can be any coating composition that comprises a resin. Preferably, the coating composition will be a primer composition because primers are traditionally applied to a substrate before basecoats and topcoats are applied.

The term resin includes any type of resin, binder, or polymer that can be included in a coating composition. Examples of resin include, but are not limited to, polyesters, polyacrylates, polyurethanes, polyamides, polylactones, polycarbonates, polyolefins, alkyds, oil-modified alkyds, epoxy-unsaturated fatty acid ester resins, addition resins with pendent olefinic groups, condensation resins with pendent olefinic groups, lacquer resins, and cellulose esters. Preferably, the resin is a polyurethane.

The adhesion of a coating to the substrate that has been treated according to the present invention can be increased up to 80% or more over the same coating applied to the substrate without being treated according to the present invention as measured by Ford test FLTM B1 104-01. The test ranks adhesion loss on a scale from 0 (no adhesion loss) to 10 (100%) adhesion loss.

SPECIFIC EMBODIMENTS OF THE INVENTION

The invention is further described in the following examples. The examples are merely illustrative and do not in any way limit the scope of the invention as described and claimed. The test methods used in the examples are adhesion loss after 10-days water immersion according to Ford test FLTM B1 104-01.

Zirconium IV 2,2(bis-2-propenolatomethyl) butanolato, tris 2-methyl-2-propenoato-O (NZ33) and Zirconium IV 2,2(bis-2-propenolatomethyl) butanolato, tris 2-propenoato-O (NZ39) (each available from Kenrich Petrochemicals, Inc.) were each added at a level of 1% by weight to an acid etch reducer composition, GLASURIT® 352-228 etch primer available from BASF Corporation. Each composition was wiped onto a galvanized metal panel. The panels were not subsequently rinsed or cleaned any further. A primer composition containing a polyurethane resin, available from BASF Corporation as DP200, was applied to each panel. The panels were then aged, sanded, cleaned, and then a white basecoat, available from BASF Corporation as line-55, was applied, and then the panels were clearcoated with a clearcoat, available from BASF Corporation as DC98. The panels air dried for 4 days at room temperature, and then they were baked at 140° F. for 1 hour. The panels had an adhesion loss of 0 at initial testing and 2 after 10-days of water immersion.

A control panel was prepared as above, except that no acid and no zirconium alkoxide were used. Adhesion loss results obtained for this panel was 10 after 10-days of water immersion.

A comparative panel was prepared as above, except that no acid was used. Adhesion loss results for this panel were 4 at initial testing and 10 after 10-days of water immersion.

A comparative panel was prepared as above, except that no zirconium alkoxide was used. Adhesion loss results for this panel were 0 at initial testing and 10 after 10-days water immersion.

The above tests show that when the combination of the acid and zirconium alkoxide are applied to a substrate, the adhesion loss is reduced as compared to using only the acid or the zirconium alkoxide or neither.

It should be appreciated that the present invention is not limited to the specific embodiments described above, but includes variations, modifications and equivalent embodiments defined by the following claims.

What is claimed is:

1. A method comprising:

a. providing a composition comprising a zirconium alkoxide and an acid, wherein the composition is not provided in a coating composition, wherein the coating composition comprises a resin; and b. applying the composition to a substrate, wherein the zirconium alkoxide is at least one of:

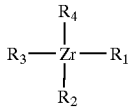

i) wherein $R_1$, $R_2$, $R_3$, $R_4$ art each independently an alkoxy group and at least one of a) the alkoxy group contains at least one heteroatom that is at least one of nitrogen, phosphorous, and sulfur, and b) at least two of $R_1$, $R_2$, $R_3$, $R_4$ are bridged to each other,

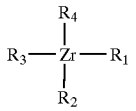

ii) wherein $R_1$, $R_2$, $R_3$, $R_4$ are each independently an alkoxy group and the alkoxy group does not contain any heteroatoms, iii) the zirconium alkoxide has a structure comprising

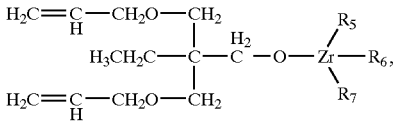

wherein, $R_5$, $R_6$, and $R_7$ are each independently an alkoxy group, iv) the zirconium alkoxide has a structure comprising

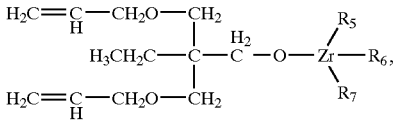

wherein, $R_5$, $R_6$, and $R_7$ are each independently an alkoxy group, and wherein at least one of i) the alkoxy group contains at least one heteroatom, and ii) at least two of the alkoxy group, $R_5$, $R_6$, and $R_7$ are bridged to each other, and the zirconium alkoxide is at least one of: Zirconium IV 2,2(bis-2-propenolatomethyl) butanolato, tris neodecanolato-O; Zirconium IV 2,2(bis-2-propenolatomethyl) butanolato, tris (dodecyl) benzensulfonato-O; Zirconium IV 2,2(bis-2-propenolatomethyl) butanolato, tris (dioctyl) phosphato-O; Zirconium IV 2,2(bis-2-propenolatomethyl) butanolato, bis 2-methyl-2-propenoato-O; Zirconium IV 2,2(bis-2-propenolatomethyl) butanolato, tris (dioxtyl) pyrophosphato-O; Zirconium IV 2,2(bis2-propenolatomethyl) butanolato, tris 2-propenoato-O; Zirconium IV 2,2(bis-2-propenolatomethyl) butanolato, tris (2-ethylenediamino) ethylato; Zirconium IV bis 2,2(bis-2-propenolatomethyl) butanolato, bis (para amino benzoato-O); Zirconium IV bis (2,2(bis-2-propenolatomethyl) butanolato, bis (3-mercapto) propionato-O; Zirconium IV 2,2(bis-2-propenolatomethyl) butanolato, tris (2-amino) phenylato; Zirconium IV 2,2-dimethyl 1,3 propanedilato, bis (dioctyl) pyrophosphato-O, (adduct) 2 moles N,N-dimethylamino-alkyl propenoamide; Zirconium IV (2-ethyl, 2-propenolatomethyl) 1,3-prapanedilato, cyclo bis 2-dimethylamino pyrophosphato-O,O adduct with 2 moles of methansulfonic acid; Zirconium IV tetrakis 2,2(bis-2propenolatomethyl)butanolato, adduct with 2 moles of ditridecyl, hydrogen phosphite; Zirconium IV 2-ethyl, 2-propenolatomethyl 1,3-propanediolato, cyclo di 2,2-(bis 2-propenolatomethyl) butanolato pyrophosphato-O, O; and Zirconium IV bis 2-ethylhexanolato, cyclo (di 2-ethylhexyl) pyrophosphato, wherein when the zirconium alkoxide consists of the zirconium alkoxide defined by ii), the acid is at least one of phosphoric acid and phosphoric acid esters.

2. The method of claim 1 further comprising rinsing the substrate after applying.

3. The method of claim 1, wherein the substrate is not rinsed after applying.

4. The method of claim 1, wherein the zirconium alkoxide does not contain any other metals.

5. The method of claim 1, wherein the acid is at least one of phosphoric acid and phosphoric acid esters.

6. The method of claim 1, wherein the zirconium alkoxide is preset in the composition in an amount from about 0.01% to about 5% by weight of the composition.

7. The method of claim 1, wherein the acid is present in the composition in an amount from about 0.1% to about 10.0% by weight of the composition.

8. The method of claim 1, wherein the substrate is a metal.

9. The method of claim 1, wherein the substrate is a metal that is one of steel, galvanized steel, iron, galvanized iron, aluminum, aluminum alloy, zinc, zinc alloy plated steel, cold rolled steel, titanium, titanium alloy, cadmium, and magnesium.

10. The method of claim 1 further comprising applying a coating to the substrate.

11. The method of claim 10, wherein the coating is a primer.

12. The method of claim 10, wherein the coating has an adhesion to the substrate that is up to 80% greater than when the coating is applied to the substrate that was not treated with composition as measured by Ford test FLTM B1 104-01.

13. The method of claim 10, wherein the coating comprises a binder that is at least one of a polyester, a polyacrylate, a polyurethane, a polyamide, a polylactone, a polycarbonate, a polyolefin, an alkyd, an oil-modified alkyd, an epoxy-unsaturated fatty acid ester resin, an addition resin with pendent olefinic groups, a condensation resin with pendent olefinic groups, a lacquer resin, and a cellulose ester.

14. The method of claim 10, wherein the coating comprises a polyurethane resin.

15. The method of claim 11 further comprising applying a basecoat over the primer, and optionally applying a topcoat over the basecoat.

* * * * *